US005892492A

United States Patent [19]

Osawa et al.

[11] Patent Number: 5,892,492

[45] Date of Patent: Apr. 6, 1999

[54] PLASMA DISPLAY PANEL WITH OPTICAL FILTERS

[75] Inventors: Atsuo Osawa, Yokohama; Michitaka Ohsawa, Fujisawa; Masaji Ishigaki, Yokohama; Norio Yatsuda, Chigasaki; Takashi Sasaki, Hiratsuka, all of Japan

[73] Assignee: Hitachi, Ltd., Tokyo, Japan

[21] Appl. No.: 706,952

[22] Filed: Sep. 3, 1996

[30] Foreign Application Priority Data

Sep. 20, 1995 [JP] Japan ..... 7-241867

[51] Int. Cl.[6] ..... G09G 3/28

[52] U.S. Cl. ..... 345/60; 345/72; 313/485

[58] Field of Search ..... 345/60, 63, 65, 345/66, 72, 71; 315/169.4; 313/486, 586, 493, 484, 485

[56] References Cited

U.S. PATENT DOCUMENTS

| | | | |
|---|---|---|---|
| 4,741,962 | 5/1988 | Wada et al. . | |
| 4,803,402 | 2/1989 | Raber et al. . | |
| 5,396,149 | 3/1995 | Kwon | 345/65 |

FOREIGN PATENT DOCUMENTS

| | | | |
|---|---|---|---|
| 2699717 | 6/1994 | France . | |
| 59-36280A | 2/1984 | Japan . | |
| 61-6151A | 1/1986 | Japan . | |
| 5-205643A | 8/1993 | Japan . | |
| 0222341 | 8/1994 | Japan | 345/60 |
| 0222346 | 8/1994 | Japan | 345/60 |

*Primary Examiner*—Chanh Nguyen
*Attorney, Agent, or Firm*—Kenyon & Kenyon

[57] ABSTRACT

To achieve an expansion of color reproducibility and an improvement in contrast ratio, color filters 8R, 8G and 8B formed in stripes are successively arranged on one surface of a front glass substrate 1, interposing a black matrixes 7 between them. Sustaining electrodes 6 are provided thereon and a dielectric layer 9 and a protecting layer 10 are provided. On a rear glass substrate 2, barrier ribs 3 are provided in the manner they face the respective black matrixes 7, and thus the spaces between the barrier ribs 3 facing the respective color filters 8R, 8G and 8B form cells. The cells are respectively provided with the sustaining electrodes 6 falling at right angles with the address electrodes 4, coated with fluorescent substances 5R, 5G and 5B corresponding to the respective colors, and also sealed to hold discharge gas therein. A wave band selecting filter 11 for screening the light emitted from the discharge gas in the respective cells is provided on the other surface of the front glass substrate 1.

19 Claims, 11 Drawing Sheets

PLASMA DISPLAY PANEL WITH OPTICAL FILTERS

BACKGROUND OF THE INVENTION

1. Field of the Invention

This invention relates to a plasma display device used as various thin-type display panels, and more particularly to a plasma display panel in which a fluorescent substance is excited with energy of ultraviolet rays to produce visible light.

2. Description of Related Art

Plasma display panels (PDP) can be made dramatically small in depth compared with cathode-ray tube direct-view type display units and rear projection display units, and have been expected as a promising means for realizing wall type large-screen televisions in the future. At present, however, such plasma display panels are on such a level of development that they have still a lower contrast ratio and brightness than the existing display units. In order for them to come into wide use in the future, it is essential to achieve a great improvement in such performances.

Under such circumstances, as a measure for improving contrast ratios and color purities of plasma display panels, Japanese Patent Applications Laid-open (KOKAI) No. 59-36280 and No. 61-6151, for example, disclose techniques in which optical filters formed of an inorganic material are imparted to individual cells.

In these techniques, the optical filters are dividedly arranged so as to correspond to individual cells, on a glass substrate provided in front of a cell board, and have transmittance corresponding to the luminescent colors of the individual cells. Spectra of light emitted from fluorescent substances provided inside the individual cells change correspondingly to the transmittance of the filters to bring about an improvement in color purity of red, green and blue each.

The fluorescent substances used in plasma display panels commonly tend to reflect light coming from the outside (i.e., ambient light). Especially in an environment having bright surroundings, they may cause a rise in apparent black level to tend to cause a decrease in contrast ratio of display units. The optical filters provided correspondingly to the individual cells attenuate the ambient light incident on the fluorescent substances and also again attenuate the ambient light component reflected from the fluorescent substances before it is emergent outside, so that the contrast ratio in a bright environment can be greatly improved.

In the above conventional techniques, process temperatures in the production of plasma display panels are estimated to be about 500° C. to about 600° C., and hence inorganic materials resistant to high temperatures are used in the optical filters. If, however, the process temperatures can be dropped to about 250° C., it is possible to use optical filters made of organic materials that enable much sharper change in transmittance and is possible to more improve color purity.

The above filter technique is supposed to step by step bring about improvements of color purities of the three primary colors, red, green and blue. In the case of plasma display panels, however, luminescent color of discharge gas sealed in panels is a great factor that obstructs the improvement in color purity. As the discharge gas sealed in panels, a gas chiefly composed of neon (Ne) gas and mixed with xenon (Xe) gas, helium (He) gas or argon (Ar) gas is usually in wide use taking account of discharge efficiency. The neon gas has an emission spectrum, as shown in FIG. 7, formed of a combination of several peak wavelength components distributed to range from the latter half of 500 nm to 700 nm, among which a component having the greatest energy is the component at 585 nm. Hence, the neon gas is discharged in orange color, which is commonly called neon orange.

Accordingly, the color purities of the respective three primary colors, red, green and blue, should be improved through the optical filter provided for each cell and also the discharge color of neon gas sealed in panels should be removed as far as possible. These are essential subjects for improving color purity and for expanding color reproducibility, as required for display units of plasma display panels.

SUMMARY OF THE INVENTION

An object of the present invention is to provide a plasma display panel that can control to attenuate the discharge color of neon gas and has made it possible to achieve an improvement in color purity and an expansion of color reproducible range.

To achieve the above object, the plasma display panel of the present invention is provided with a first optical filter corresponding to each of the three primary colors, provided for each cell, and in addition thereto a second optical filter having such a transmittance that the energy of discharge light of discharge gas is attenuated; the second optical filter being provided on at least one surface of a panel member constituting the front of the plasma display panel.

The first optical filter, which has a transmittance corresponding to each monochromatic component, is provided at each opening of cells coated with fluorescent substances of the three primary colors, red, green and blue and forming individual pixels. These optical filters have characteristics such that they have a high transmittance for individual principal wavelength components of the three primary colors and have a low transmittance for other wavelength components, so that the energy of undesirable wavelength components are controlled and attenuated.

The second optical filter has the function to control and attenuate the energy of principal wavelength components of discharge light of discharge gas and their surrounding wavelength components.

These and other features and advantages of the present invention are described in or will become apparent from the following description of the preferred embodiments.

DESCRIPTION OF THE PREFERRED EMBODIMENTS

The present invention will be described below in detail with reference to the accompanying drawings.

Figure 1:
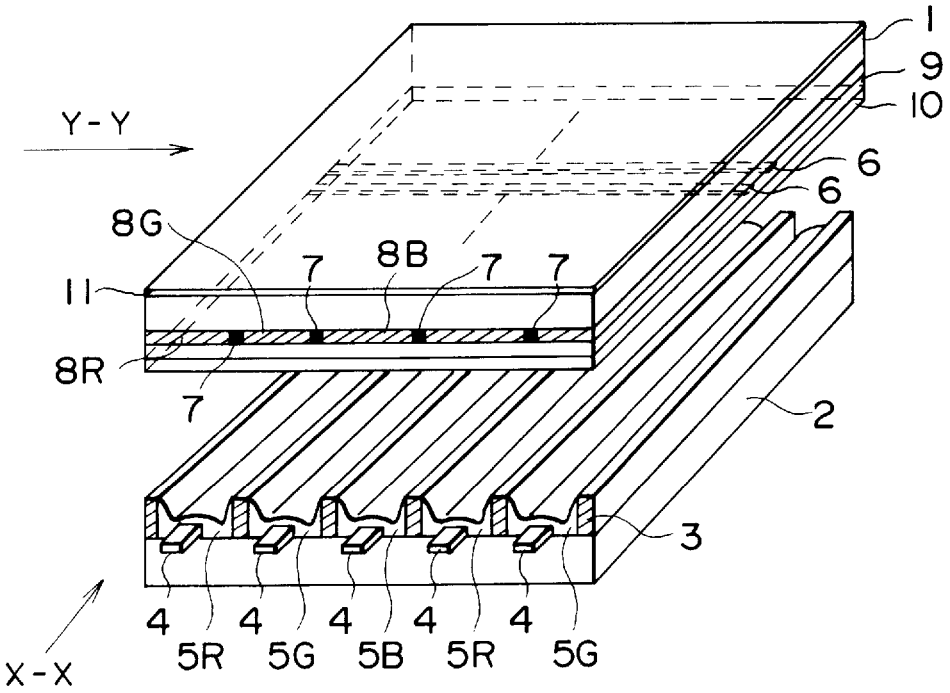
FIG. 1 is a perspective view illustrating the whole construction of an example of the plasma display panel according to the present invention.
Figure 2:
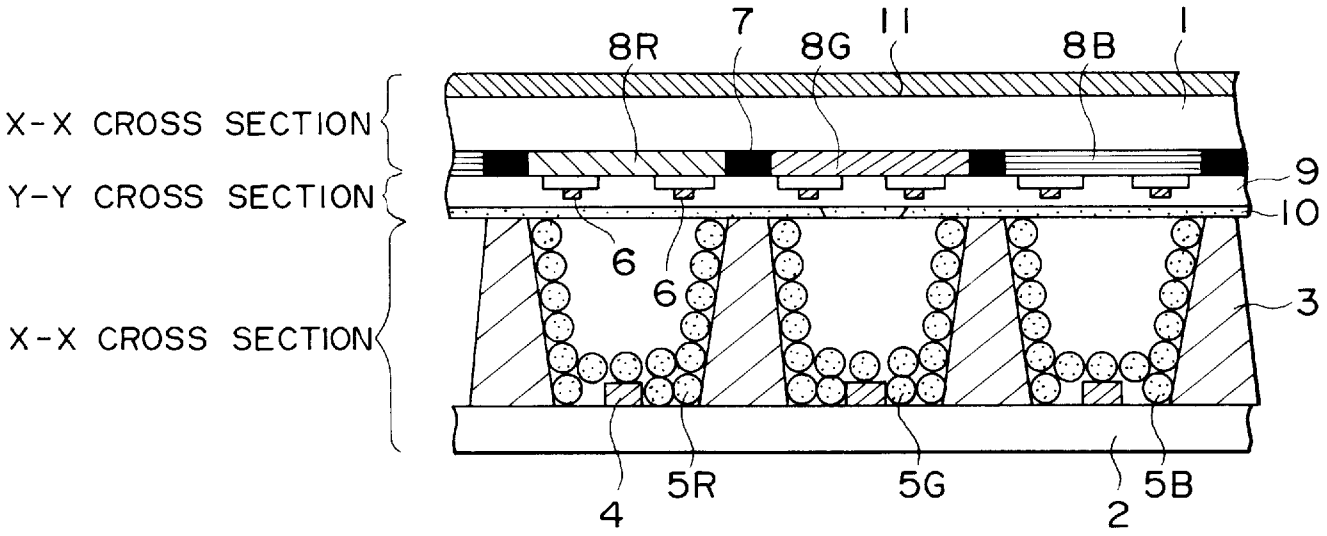
FIG. 2 is an enlarged view of partial cross sections in FIG. 1.

FIG. 1 is a perspective view illustrating the whole construction of an example of the plasma display panel according to the present invention, and FIG. 2 is an enlarged view of partial cross sections thereof. Reference numeral 1 denotes a front glass substrate (a front panel); 2, a rear glass substrate (a rear panel); 3, barrier ribs; 4, address electrodes; 5R, 5G and 5B, fluorescent substances; 6, sustaining electrodes; 7, black matrixes; 8R, 8G and 8B, color filters; 9, a dielectric layer; 10, a protecting layer; and 11, a wave band selecting filter.

In FIGS. 1 and 2, the embodiment shown therein has the construction wherein the front glass substrate 1 and the rear glass substrate 2 face to each other, interposing the barrier ribs 3 between them.

The sustaining electrodes 6 and the address electrodes 4 are formed inside the front glass substrate 1 and inside the rear glass substrate 2, respectively, by photoetching or the like. The sustaining electrodes 6 formed inside the front glass substrate 1 and the address electrodes 4 formed inside the rear glass substrate 2 are respectively face to face provided so as to fall at right angles with one another.

The sustaining electrodes 6 on the front glass substrate 1 is covered with the dielectric layer 9 formed by baking and having a stated thickness, and the protecting layer 10 is formed thereon. Between the surface of the front glass substrate 1 and the sustaining electrodes 6 and dielectric layer 9, the color filters 8R, 8G and 8B are formed in stripes for the respective colors of red (R), green (G) and blue (B) in the manner they are respectively arranged in the direction falling at right angles with the sustaining electrodes 6 while keeping given intervals through the black matrixes 7.

In FIG. 2, in order to show the cross-sectional structure of the sustaining electrodes 6 at the same time, the color filters 8R, 8G and 8B and the sustaining electrodes 6 are illustrated as if they are arranged in parallel to one another. In fact, the sustaining electrodes 6 respectively fall at right angles with the color filters 8R, 8G and 8B and the address electrodes 4 on the rear glass substrate 2. Namely, in FIG. 2, the part of the sustaining electrodes 6 on the side of the front glass substrate 1 is illustrated as a cross section viewed in the direction Y—Y in FIG. 1, and other parts as cross sections viewed in the direction X—X in FIG. 1.

On the rear glass substrate 2, the barrier ribs 3 are superposingly formed by thick-film printing so as to interpose the respective address electrodes 4, where barrier ribs 3 adjacent to each other stand in pair to form a cell. These barrier ribs 3 respectively face the black matrixes 7 formed on the front glass substrate 1, and the individual cells also respectively face the color filters 8R, 8G and 8B formed on the front glass substrate 1. In the cell facing the color filter 8R, in the cell facing the color filter 8G and in the cell facing the color filter 8B, a fluorescent substance 5R corresponding to red luminescent color, a fluorescent substance 5G corresponding to green luminescent color and a fluorescent substance 5B corresponding to blue luminescent color are coated, respectively, in the manner that they respectively cover the address electrodes 4.

Thus, the color filters 8R, 8G and 8B are arranged one by one correspondingly to the cells formed by the barrier ribs 3, and have transmittance corresponding to each of the luminescent colors of the fluorescent substances 5R, 5G and 5B provided inside the cells. In the spaces of such cells, a discharge gas chiefly composed of neon gas is sealed, and hence the respective cells form discharge cells. The black matrixes 7 arranged between the respective color filters 8R, 8G and 8B have the function to decrease undesirable reflection of ambient light from end faces of the barrier ribs 3.

Meanwhile, on the surface of the front glass substrate 1, the wave band selecting filter 11 is formed by thin-film coating.

Discharge cells are positioned at the respective intersections where the address electrode 4 and sustaining electrode 6 fall at right angles, and the individual discharge cells form pixels. Thus, it follows that a plurality of pixels are arranged in a matrix fashion.

Figure 3:
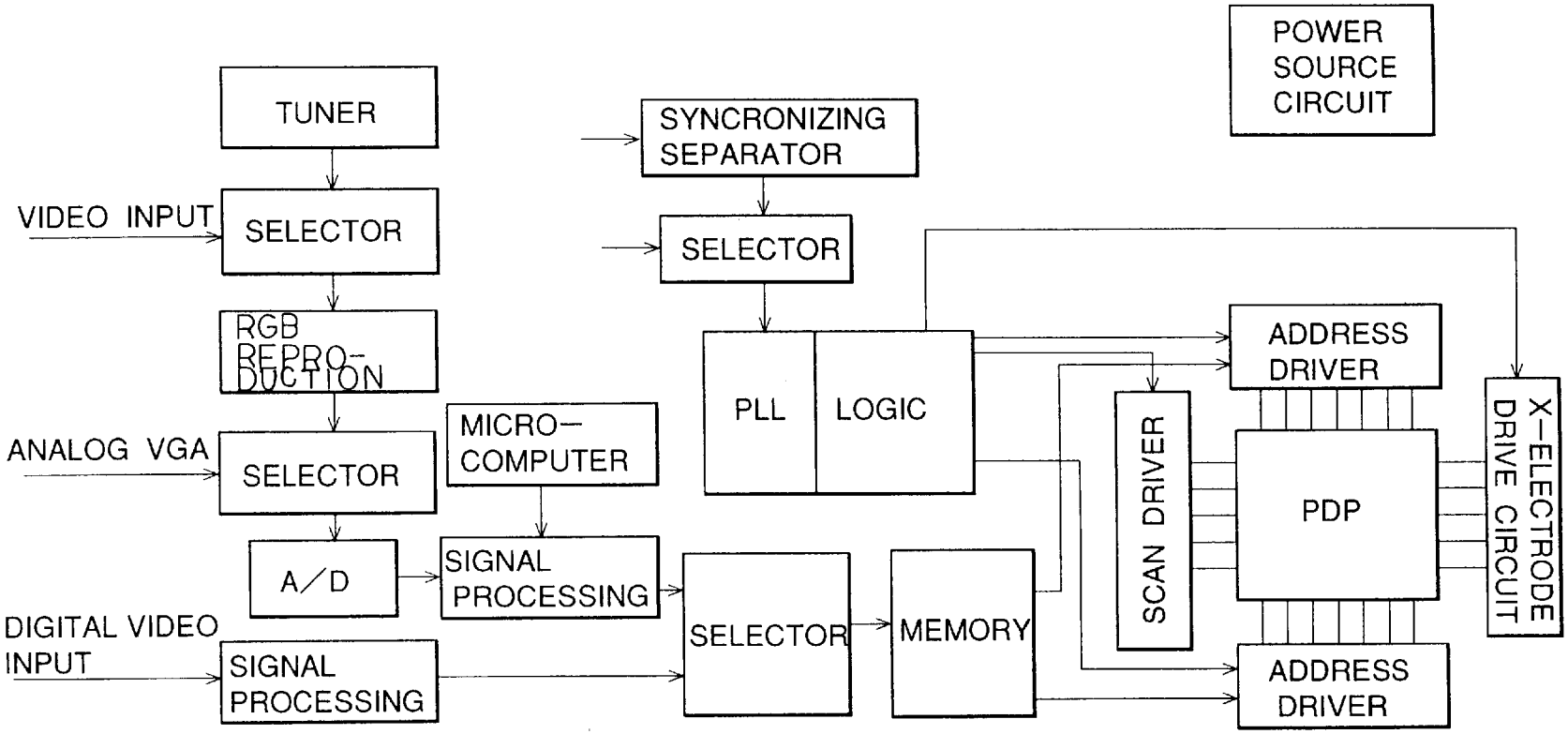
FIG. 3 is a block diagram illustrating the system construction of a plasma display unit.

FIG. 3 is a block diagram illustrating the system construction of such a plasma display unit.

As shown in FIG. 3, an address driver and a scan driver apply stated voltages to the address electrodes 4 and the sustaining electrodes 6, respectively, at stated timing. As the result, the discharge gas inside the discharge cells is excited to emit ultraviolet rays, and the ultraviolet rays excite the fluorescent substances 5R, 5G and 5B, so that the discharge cells emit light. Since the discharge cells are arranged in a matrix fashion, the discharge cells may be made to selectively and continuously cause discharge and emission in accordance with input signals using a logic and a memory as shown in FIG. 3, whereby the information corresponding to the input signals can be visually displayed on the plasma display panel (PDP).

Figure 4:
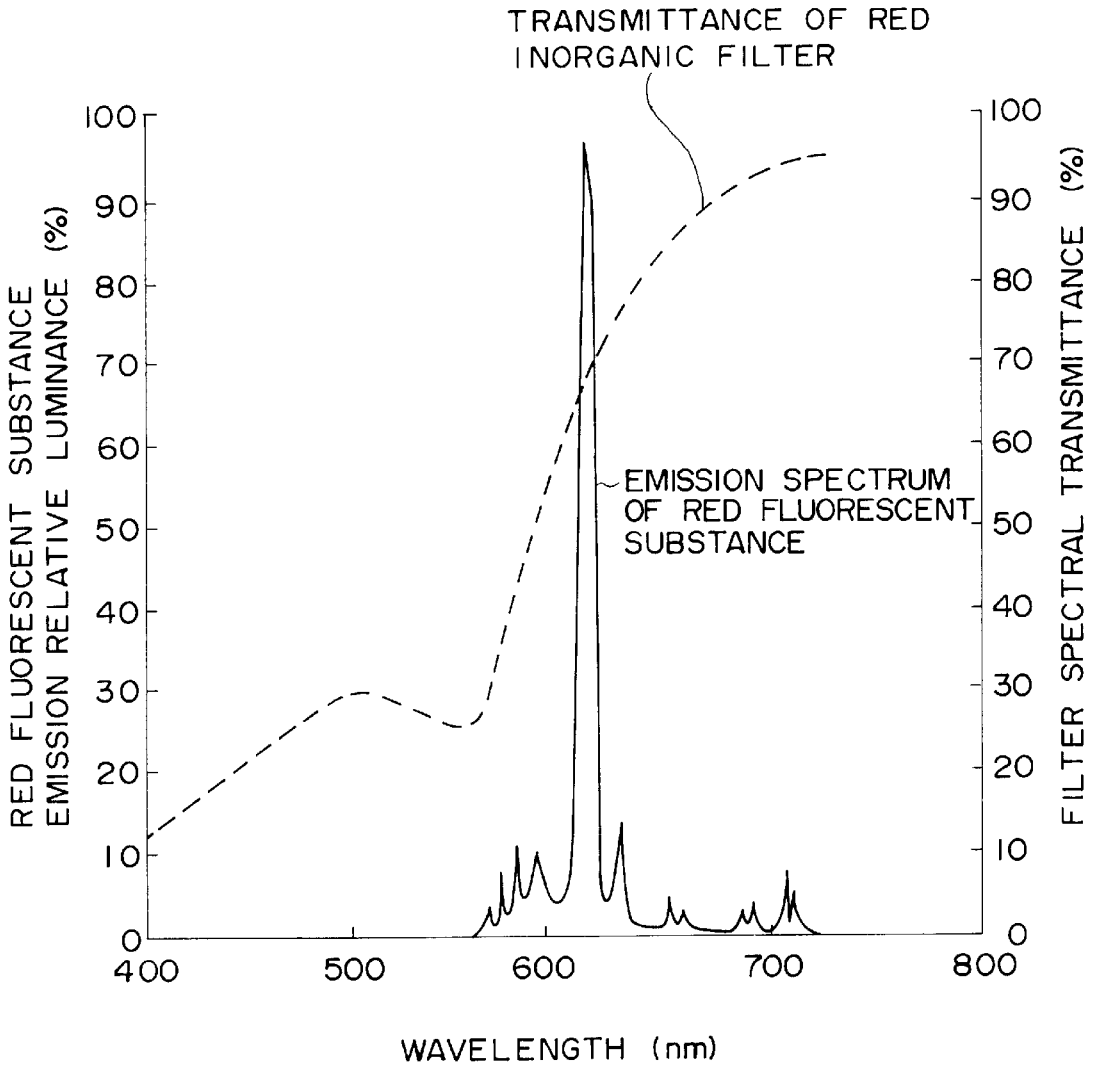
FIG. 4 is a graph showing the emission spectrum of a red fluorescent substance and the transmittance of a red color filter making use of an inorganic material, with regard to those shown in FIG. 2.

FIG. 4 is a graph showing the emission spectrum (a solid line) of the red fluorescent substance 5R and the spectral transmittance (a broken line) of a red color optical filter (the color filter 8R) disposed at the openings of the cells coated with the red fluorescent substance 5R.

As shown by the solid line in FIG. 4, the emission spectrum of the red fluorescent substance 5R has such an energy distribution that it has an extremely large peak component at about 610 nm and, at its skirt, small spurious components scattering in the wavelength region of from about 580 nm to about 710 nm.

In contrast thereto, the red color optical filter 8R has such a spectral transmittance that, as shown in the broken line, the energy of the short-wavelength side component in the emission spectrum of the red fluorescent substance 5R is controlled to be attenuated and the long-wavelength side component is more transmitted. Hence, the luminescent color of the red fluorescent substance 5R is shifted toward the red side. This brings about an improvement in color purity of the luminescent color of the red fluorescent substance 5R.

Figure 5:
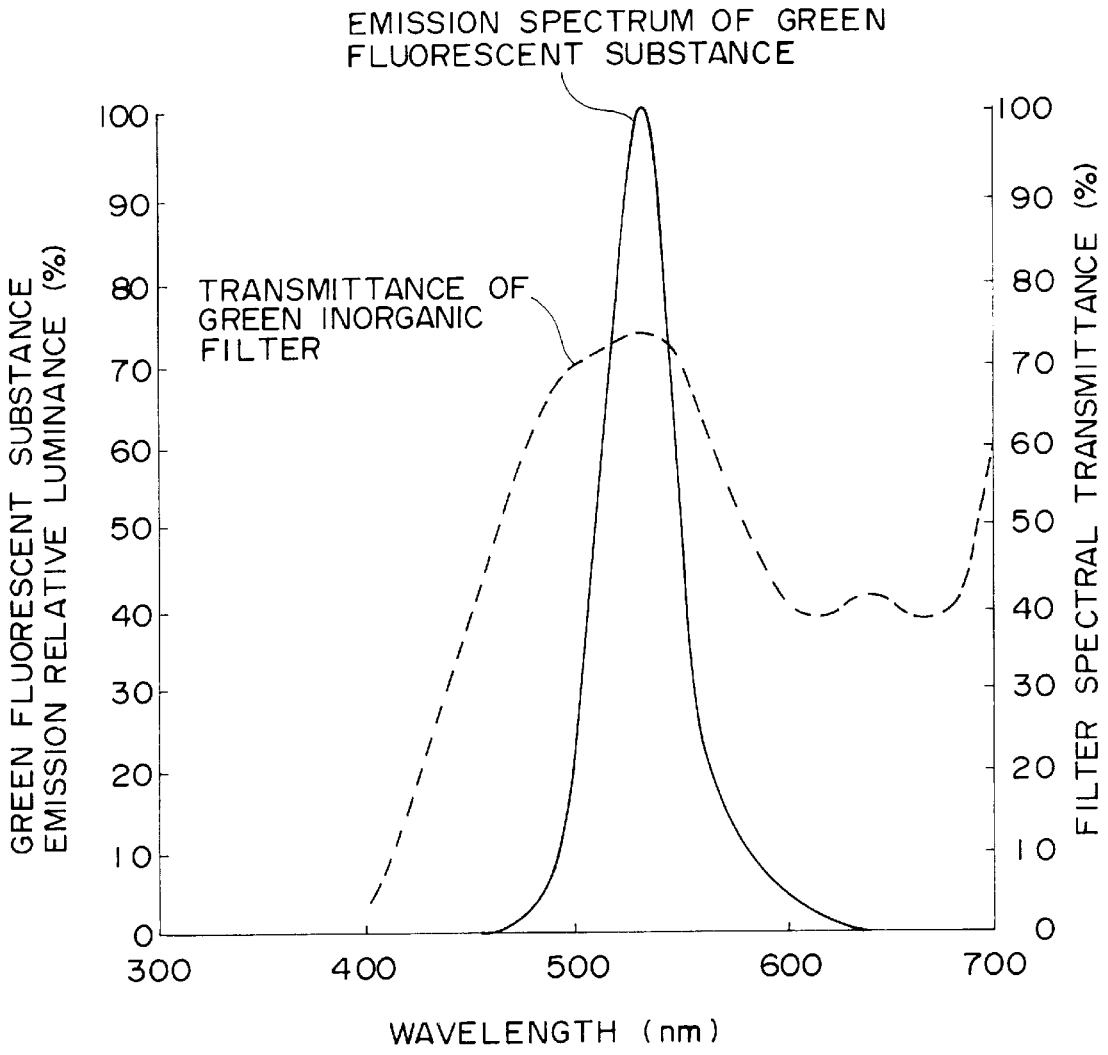
FIG. 5 is a graph showing the emission spectrum of a green fluorescent substance and the transmittance of a green color filter making use of an inorganic material, with regard to those shown in FIG. 2.

FIG. 5 is a graph showing the emission spectrum (a solid line) of the green fluorescent substance 5G and the spectral transmittance (a broken line) of a green color optical filter (the color filter 8G) disposed at the openings of the cells coated with the green fluorescent substance 5G.

As shown by the solid line in FIG. 5, the emission spectrum of the green fluorescent substance 5G has such an energy distribution that it has a peak at about 535 nm and has a skirt extending over a broad range of from about 470 nm on the short-wavelength side to about 700 nm on the long-wavelength side.

In contrast thereto, the green color optical filter 8G has such a spectral transmittance that, as the energy of both thee, the energy of both the short-wavelength blue-side component and the long-wavelength red-side component in the emission spectrum of the green fluorescent substance 5G is controlled to be attenuated and the central pure green component is more transmitted. This brings about an improvement in color purity of the luminescent color of the green fluorescent substance 5G.

Figure 6:
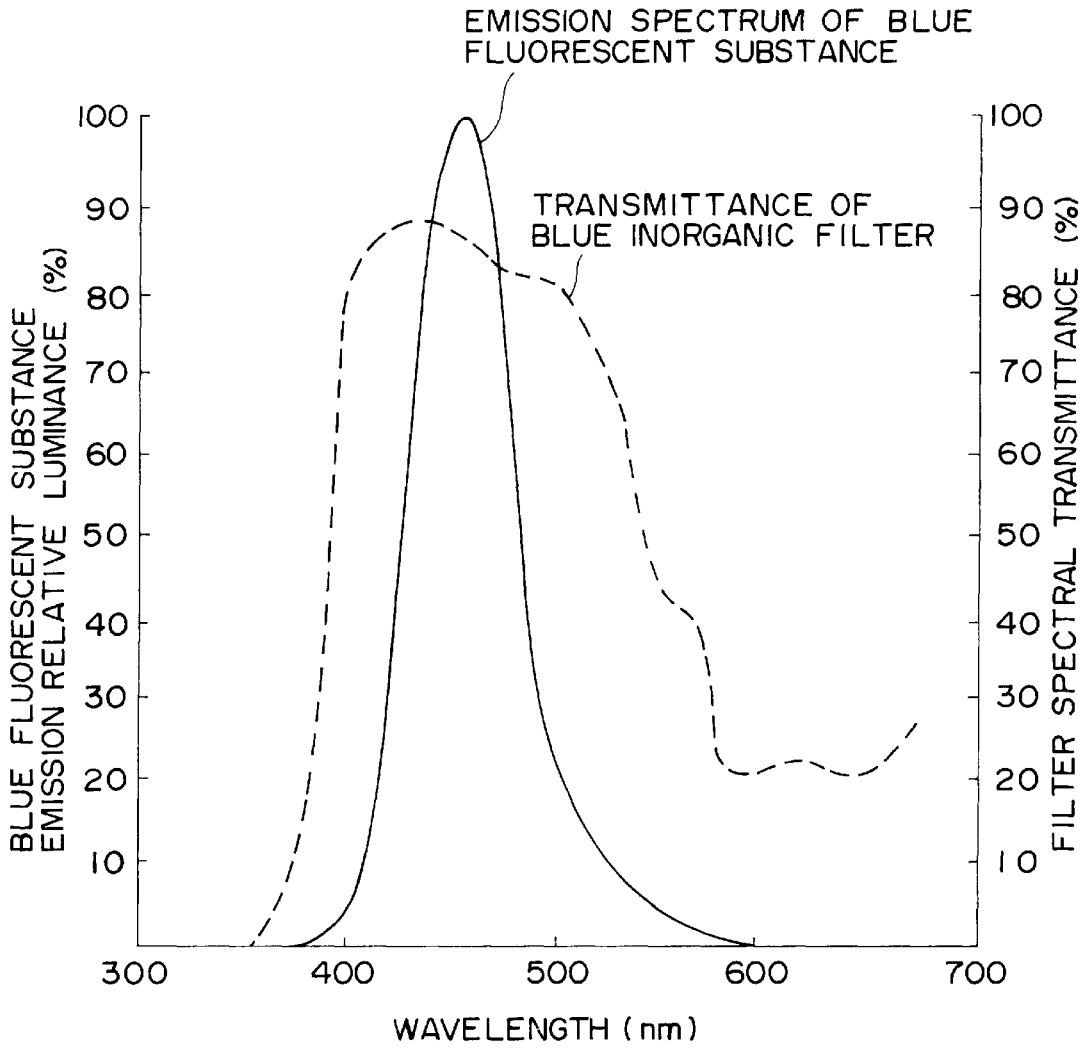
FIG. 6 is a graph showing the emission spectrum of a blue fluorescent substance and the transmittance of a blue color filter making use of an inorganic material, with regard to those shown in FIG. 2.

FIG. 6 is a graph showing the emission spectrum (a solid line) of the blue fluorescent substance 5B and the spectral transmittance (a broken line) of a blue color optical filter (the color filter 8B) disposed at the openings of the cells coated with the blue fluorescent substance 5B.

As shown by the solid line in FIG. 6, the emission spectrum of the blue fluorescent substance 5B has such an energy distribution that it has a peak at about 450 nm and has a skirt extending over a broad range of from about 390 nm on the short-wavelength side to about 600 nm on the long-wavelength side, especially, the energy on the long-wavelength side is great.

In contrast thereto, the blue color optical filter 8B has such a spectral transmittance that, as shown in the broken line, the energy of both the short-wavelength component and the long-wavelength component in the emission spectrum of the blue fluorescent substance 5B is controlled to be attenuated. This brings about an improvement in color purity of the luminescent color of the blue fluorescent substance 5B.

These color filters 8R, 8G and 8B control and attenuate twice the ambient light components reflected from the fluorescent substances 5R, 5G and 5B, respectively, i.e., when incident and when emergent. This also brings about an improvement in light-field contrast ratio of the plasma display panel.

The color filters 8R, 8G and 8B described above, corresponding to the individual pixels of red, green and blue are all formed by a process such as photolithography, using ultrafine particles of an inorganic pigment so that the filters can withstand the processing carried out at about 600° C.

Figure 7:
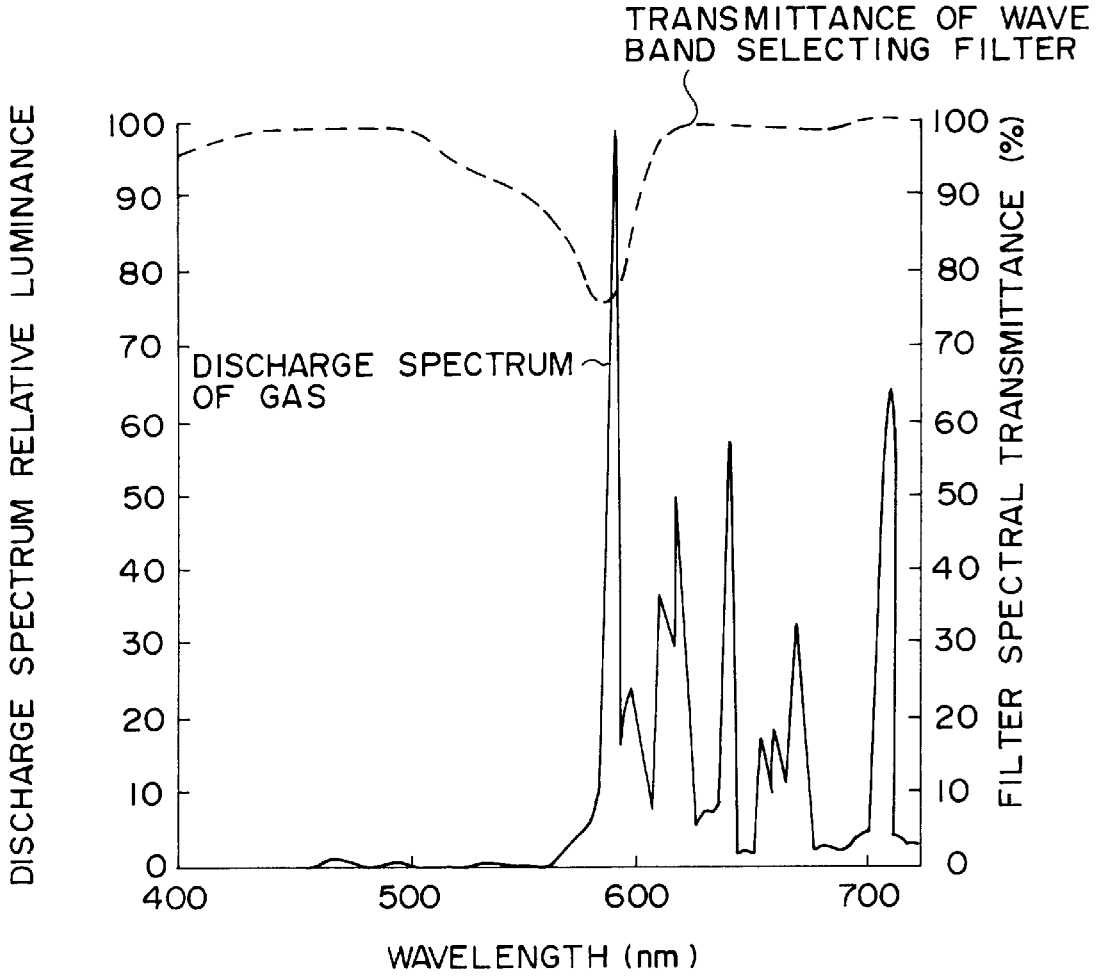
FIG. 7 is a graph showing the discharge spectrum of discharge gas in the embodiment shown in FIGS. 1 and 2 and the transmittance of an example of a wave band selecting filter shown in FIGS. 1 and 2.

FIG. 7 is a graph showing the spectral transmittance (a broken line) of the wave band selecting filter 11 provided on the surface of the front glass substrate 1 and the discharge spectrum (a solid line) of the above discharge gas sealed inside the plasma display panel.

In FIG. 7, the emission spectrum of discharge gas, shown by the solid line, indicates energy distribution obtained by the discharging of a discharge gas prepared by mixing 3% of xenon gas in neon gas. This spectrum is composed of several kinds of peak components, where a component having the greatest energy is present at about 585 nm and at a position setting toward the red side between the peak wavelength of emission spectrum of the red fluorescent substance 5R shown in FIG. 4 and the peak wavelength of emission spectrum of the green fluorescent substance 5G shown in FIG. 5. Then, this discharge gas further emits light in orange together with the red-side wavelength component. This peak wavelength may be a little shifted depending on the components of discharge gas. In the case of the discharge gas basically composed of neon gas, its peak wavelength can be within the range of from about 550 nm to about 600 nm.

Meanwhile, the wave band selecting filter 11 provided on the surface of the front glass substrate 1 is formed by a process such as thin-film coating of silica containing an organic pigment. The filter has such a spectral transmittance that, as shown by a broken line in FIG. 7, a dip is present at just about 585 nm and the energy of transmitted light having wavelengths of from about 530 nm to about 600 nm is attenuated. Hence, the wave band selecting filter 11 attenuates the energy of discharge light of the discharge gas while transmitting light almost without attenuating the energy of principal wavelength components of the red fluorescent substance 5R and green fluorescent substance 5G. This brings about an improvement in color purity of the whole system and an expansion of color reproducibility.

The wave band selecting filter 11 is also effective for decreasing unauthorized reflection due to the reflection of ambient light, and can be made more effective for it by subjecting the filter to non-glare treatment. Hence, in combination with the color filters 8R, 8G and 8B, the wave band selecting filter 11 can be useful for improving the light-field contrast ratio of the plasma display panel.

Since also the wave band selecting filter 11 makes use of an organic pigment, it has anxiety about heat resistance to process temperatures used when panels are formed. However, as shown in FIG. 2, the filter is provided on the top surface of the front glass substrate 1 (i.e., the surface on the outside of the plasma display panel). Employment of such construction makes it possible to form such a wave band selecting filter 11 after high-temperature processing has been completed, causing no problem in respect of heat resistance.

Figure 8:
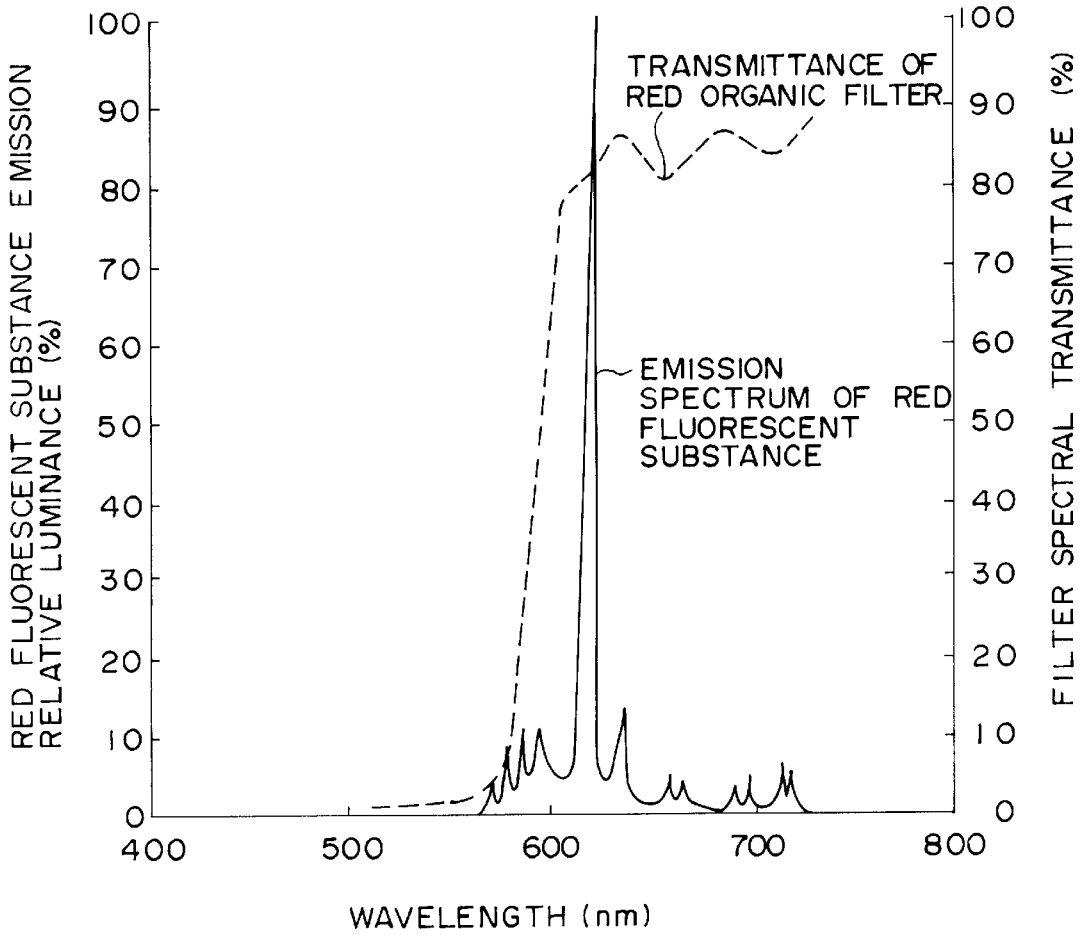
FIG. 8 is a graph showing the emission spectrum of a red fluorescent substance and the transmittance of a red color filter making use of an organic material, with regard to those shown in FIG. 2.
Figure 9:
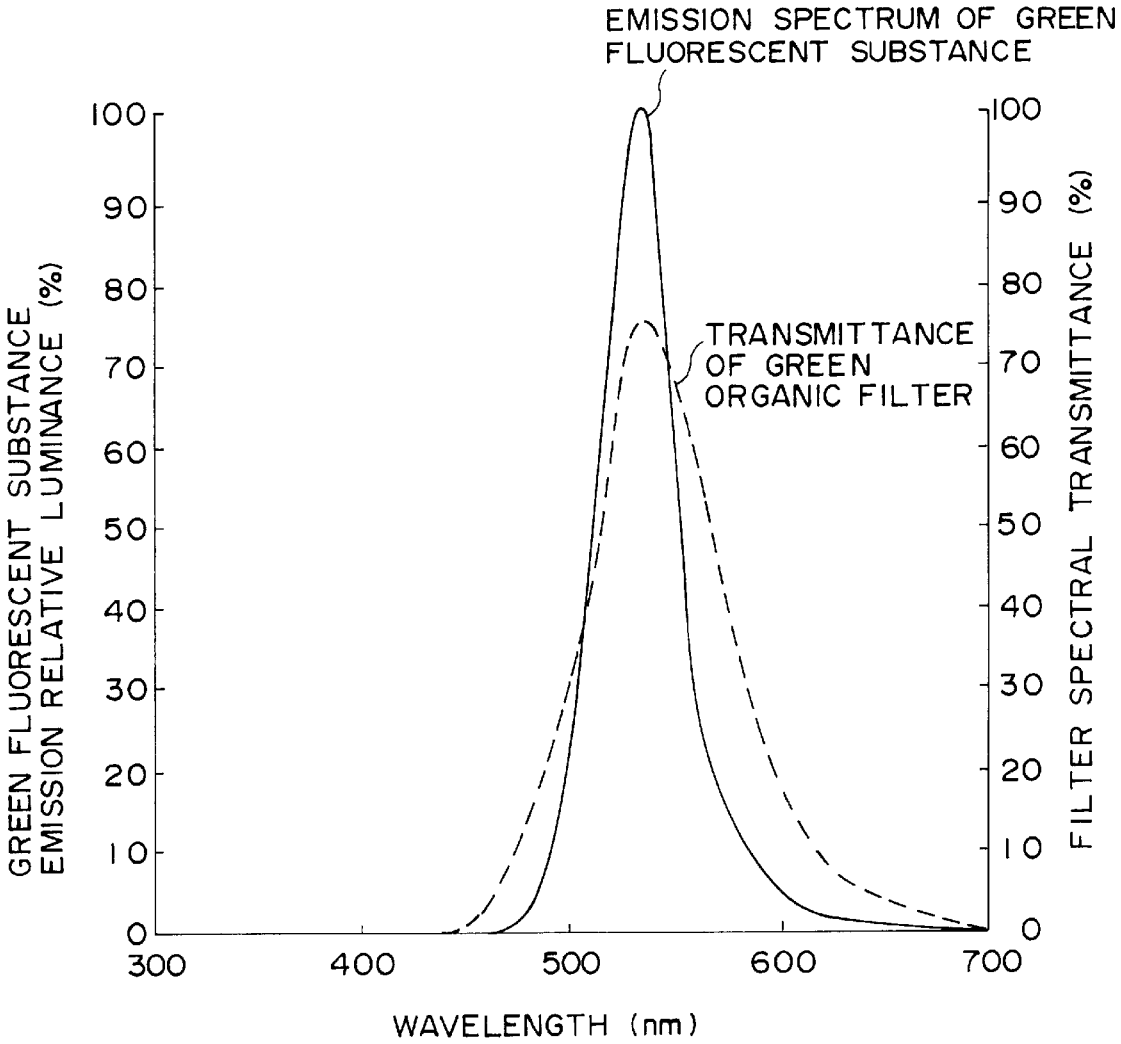
FIG. 9 is a graph showing the emission spectrum of a green fluorescent substance and the transmittance of a green color filter making use of an organic material, with regard to those shown in FIG. 2.
Figure 10:
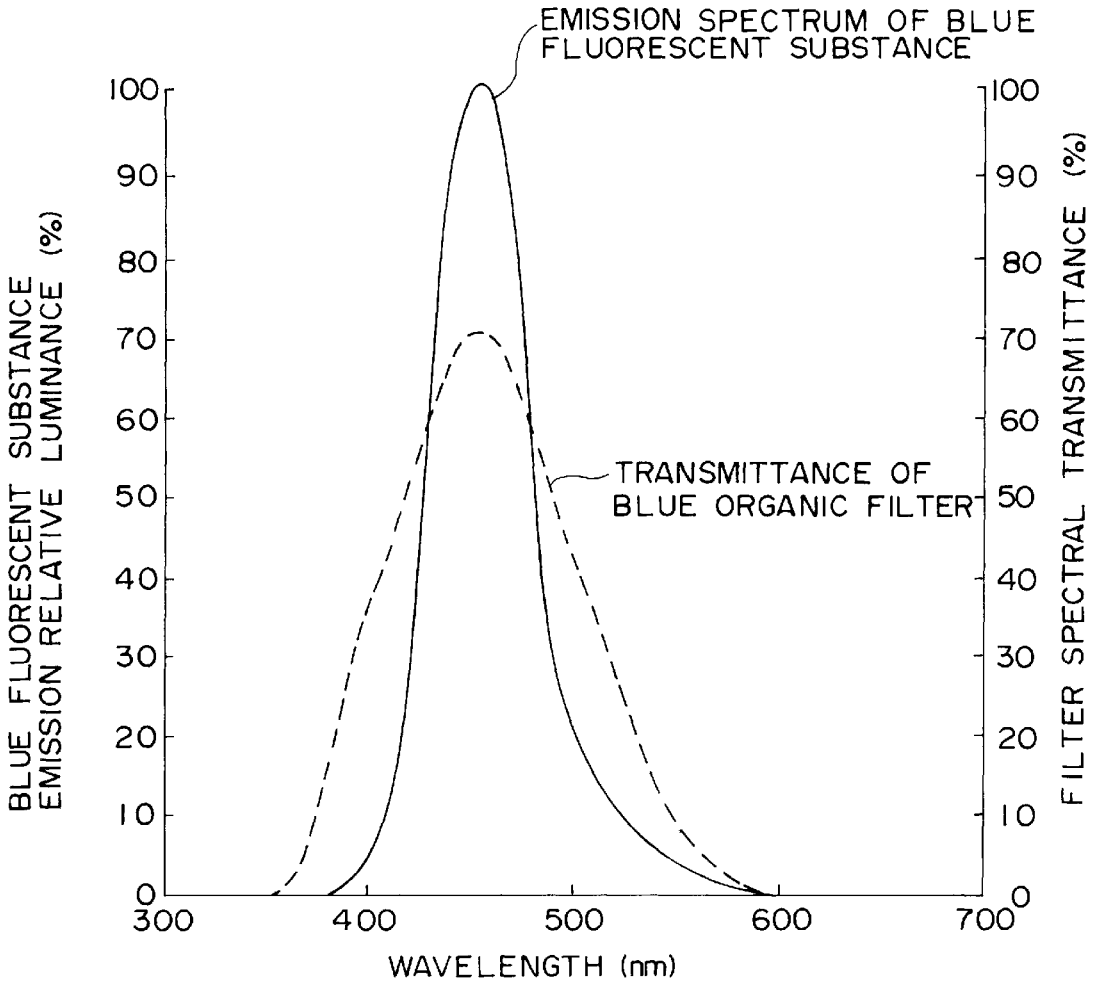
FIG. 10 is a graph showing the emission spectrum of a blue fluorescent substance and the transmittance of a blue color filter making use of an organic material, with regard to those shown in FIG. 2.

In the embodiment described above, optical filters made of an inorganic material are used as the color filters 8R, 8G and 8B corresponding to the red, green and blue fluorescent substances 5R, 5G and 5B. If the process temperature is 250° C. or below, it is also possible to use optical filters made of an organic material such as a polyimide resin, having a superior transmittance. FIGS. 8, 9 and 10 are graphs showing the emission spectra of red, green and blue fluorescent substances 5R, 5G and 5B, respectively, and the transmittance of organic material color filters 8R, 8G and 8B used correspondingly thereto. The transmittance of these color filters 8R, 8G and 8B show sharper changes in transmittance in respect of all of red, green and blue colors than the transmittance of the inorganic material color filters 8R, 8G and 8B respectively shown in FIGS. 4, 5 and 6, so that the color purity and contrast ratio of the primary colors can be more improved correspondingly.

Figure 11:
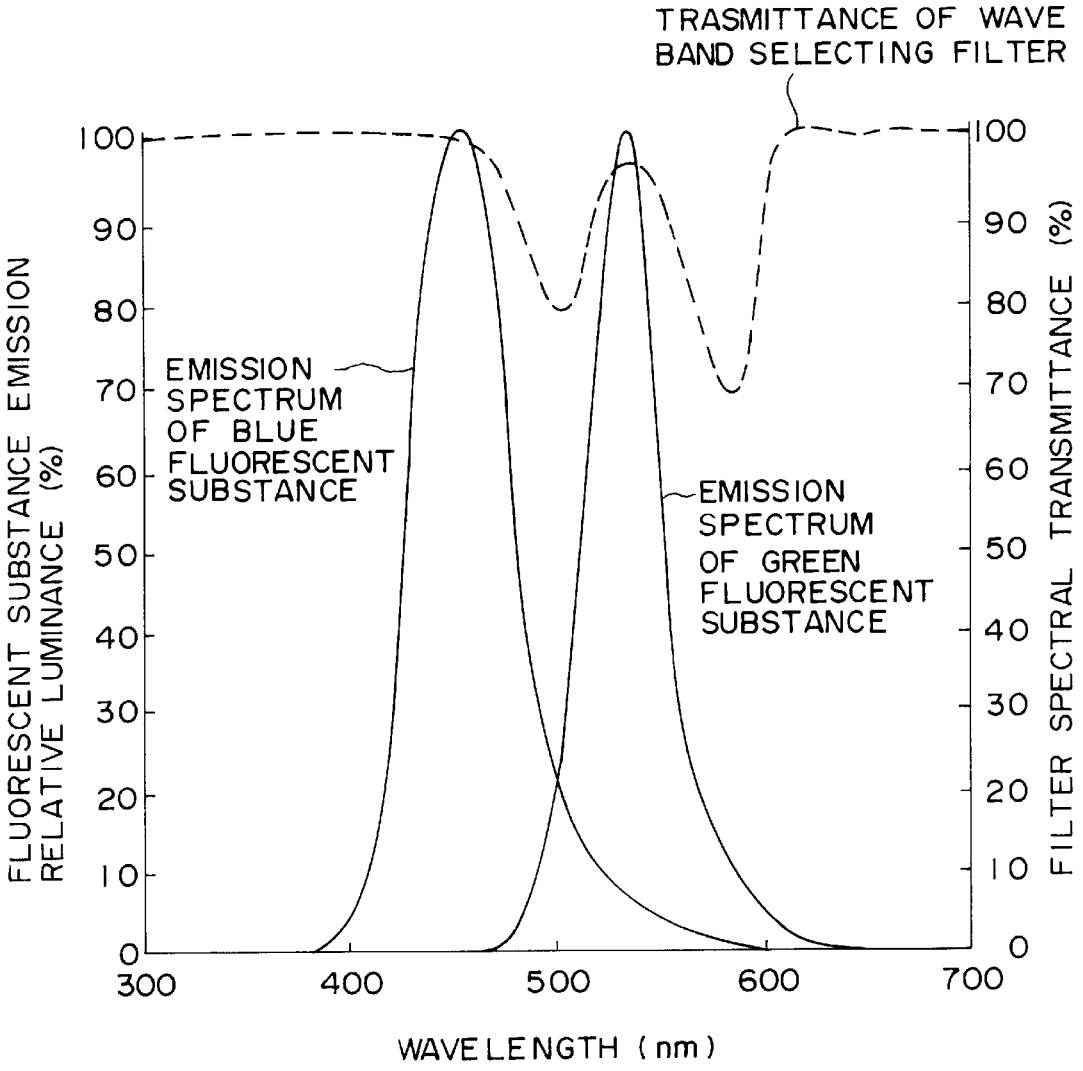
FIG. 11 is a graph showing the discharge spectra of blue and green fluorescent substances shown in FIG. 2 and the transmittance of another example of a wave band selecting filter shown in FIGS. 1 and 2.

It is also possible to provide two dips in the transmittance by mixing another organic pigment in the wave band selecting filter 11. FIG. 11 shows an example thereof. As shown in FIG. 11, a first dip of the transmittance of the wave band selecting filter 11 is present at about 585 nm like that shown in FIG. 7, whereby the energy of discharge light of the discharge gas is attenuated. A second dip of the transmittance of the wave band selecting filter 11 is positioned between the emission spectrum of the blue fluorescent substance 5B at about 500 nm and the emission spectrum of the green fluorescent substance 5G, whereby the separation of blue luminescent color from green luminescent color is improved. The wavelengths and depths of these dips depend on the type and mixing ratio of the organic materials to be mixed, and hence it is possible to make design variable according to emission spectra of fluorescent substances.

As described above, according to the present invention, the individual color purities of the three primary colors, red, green and blue, can be improved and also the emission energy of discharge gas can be controlled to be attenuated, so that the color reproducibility can be expanded and also the reflection of ambient light can be decreased to greatly improve contrast ratio.

The present invention can be worked in other forms than the foregoing embodiments without departing from the principles of the invention and the main features thereof. Accordingly, the foregoing embodiments are mere examples of the present invention in every respect and should not be construed limitative. The scope of the present invention is indicated by the claims below. Also, any changes of modifications included within the scope of equivalence of the claims are intended to be included within the scope of the present invention.

What is claimed is:

1. A plasma display panel comprising a front panel from which light is output, a plurality of cells disposed behind the front panel in such a manner that emission areas are spatially separated for each of luminescent colors, and fluorescent substances disposed inside the cells, said cells holding a discharge gas to which a voltage is applied to emit ultraviolet rays so that said fluorescent substances are excited by the energy thereof to produce visible light, wherein;

said front panel is provided with;

a first optical filter provided correspondingly to each of the luminescent colors of said fluorescent substances in the cells, and having such a transmittance that the color purity of at least one of the luminescent colors is improved; and a second optical filter having such a transmittance that at least part of the visible light produced in the course of discharging said discharge gas is attenuated.

2. The plasma display panel according to claim 1, wherein said first optical filter is provided on the side nearer to said cells than said second optical filter.

3. The plasma display panel according to claim 2, wherein said second optical filter is provided on the surface of said front panel.

4. The plasma display panel according to claim 3, wherein the transmittance of said second optical filter is so set as to attenuate the energy of emission in at least part of a wavelength region extending between emission peak wavelengths of red and green fluorescent substances.

5. The plasma display panel according to claim 4, wherein the transmittance of said second optical filter is so set as to attenuate the energy of emission in at least part of a wavelength region extending between emission peak wavelengths of blue and green fluorescent substances.

6. The plasma display panel according to claim 3, wherein the transmittance of said second optical filter is so set as to attenuate the energy of emission in at least part of a wavelength region extending between emission peak wavelengths of blue and green fluorescent substances.

7. The plasma display panel according to claim 2, wherein the transmittance of said second optical filter is so set as to attenuate the energy of emission in at least part of a wavelength region extending between emission peak wavelengths of red and green fluorescent substances.

8. The plasma display panel according to claim 7, wherein the transmittance of said second optical filter is so set as to attenuate the energy of emission in at least part of a wavelength region extending between emission peak wavelengths of blue and green fluorescent substances.

9. The plasma display panel according to claim 2, wherein the transmittance of said second optical filter is so set as to attenuate the energy of emission in at least part of a wavelength region extending between emission peak wavelengths of blue and green fluorescent substances.

10. The plasma display panel according to claim 1, wherein said second optical filter is provided on the surface of said front panel.

11. The plasma display panel according to claim 10, wherein the transmittance of said second optical filter is so set as to attenuate the energy of emission in at least part of a wavelength region extending between emission peak wavelengths of red and green fluorescent substances.

12. The plasma display panel according to claim 11, wherein the transmittance of said second optical filter is so set as to attenuate the energy of emission in at least part of a wavelength region extending between emission peak wavelengths of blue and green fluorescent substances.

13. The plasma display panel according to claim 10, wherein the transmittance of said second optical filter is so set as to attenuate the energy of emission in at least part of a wavelength region extending between emission peak wavelengths of blue and green fluorescent substances.

14. The plasma display panel according to claim 1, wherein the transmittance of said second optical filter is so set as to attenuate the energy of emission in at least part of a wavelength region extending between emission peak wavelengths of red and green fluorescent substances.

15. The plasma display panel according to claim 14, wherein the transmittance of said second optical filter is so set as to attenuate the energy of emission in at least part of a wavelength region extending between emission peak wavelengths of blue and green fluorescent substances.

16. The plasma display panel according to claim 1, wherein the transmittance of said second optical filter is so set as to attenuate the energy of emission in at least part of-a wavelength region extending between emission peak wavelengths of blue and green fluorescent substances.

17. The plasma display panel according to claim 1, wherein said second optical filter is formed of a thin film mixed with an organic pigment.

18. The plasma display panel according to claim 1, wherein said first optical filter is formed of an inorganic material.

19. The plasma display panel according to claim 1, wherein said first optical filter is formed of an organic material.

* * * * *

UNITED STATES PATENT AND TRADEMARK OFFICE

CERTIFICATE OF CORRECTION

PATENT NO. : 5,892,492

DATED : 6 April 1999

INVENTOR(S) : Atsuo OSAWA et al.

It is certified that error appears in the above-identified patent and that said Letters Patent is hereby corrected as shown below:

| Column | Line | |
|---|---|---|
| 5 | 20 | Replace "the energy of both thee" with --as shown in the broken line--. |

Signed and Sealed this

Sixth Day of June, 2000

*Attest:*

Q. TODD DICKINSON

*Attesting Officer*

*Director of Patents and Trademarks*